US012054929B2

(12) United States Patent
Sone et al.

(10) Patent No.: US 12,054,929 B2
(45) **Date of Patent: *Aug. 6, 2024**

(54) FLUSH TOILET

(71) Applicant: TOTO LTD., Kitakyushu (JP)

(72) Inventors: Chisato Sone, Fukuoka (JP); Kenichi Nakamura, Fukuoka (JP); Hiroshi Hashimoto, Fukuoka (JP); Yuichi Tsubone, Fukuoka (JP); Shigeru Okada, Fukuoka (JP); Kenichi Takano, Fukuoka (JP); Satoshi Yamazaki, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 47 days.

This patent is subject to a terminal disclaimer.

(21) Appl. No.: 17/887,537

(22) Filed: Aug. 15, 2022

(65) Prior Publication Data

US 2023/0138880 A1 May 4, 2023

(30) Foreign Application Priority Data

Oct. 29, 2021 (JP) ..... 2021-178357

(51) Int. Cl.
*E03D 11/16* (2006.01)
*E03D 11/17* (2006.01)

(52) U.S. Cl.
CPC ..... *E03D 11/16* (2013.01); *E03D 11/17* (2013.01)

(58) Field of Classification Search
CPC ..... E03D 11/16; E03D 11/17; E03D 11/13; E03D 11/18
USPC ..... 4/252.1, 252.2, 252.6
See application file for complete search history.

(56) References Cited

U.S. PATENT DOCUMENTS 5,819,326 A * 10/1998 Kobayashi ..... E03D 11/16 285/58
6,108,826 A * 8/2000 Hayashi ..... H04N 21/434 348/E5.005
8,011,029 B2 * 9/2011 Kamiya ..... E03D 11/16 4/252.1
2009/0288245 A1 * 11/2009 Kamiya ..... E03D 11/16 4/252.1
2016/0273207 A1 * 9/2016 Saito ..... E03D 11/16
2021/0108404 A1 * 4/2021 Harrison ..... E03D 3/00
2021/0285199 A1 * 9/2021 Kuru ..... E03D 11/02
2023/0137859 A1 * 5/2023 Tsubone ..... E03D 11/18 4/421

* cited by examiner

*Primary Examiner* — Lori L Baker
(74) *Attorney, Agent, or Firm* — Amin, Turocy & Watson, LLP

(57) ABSTRACT

A flush toilet includes a bowl part, a drainage water trap part that is connected to a bottom part of the bowl part, and a water drainage socket that is connected to the drainage water trap part and includes an upper side water drainage socket that extends downward from the drainage water trap part, a back side R part that is connected to the upper side water drainage socket and changes a flow channel so that a washing water that flows from an upper side is directed to a front side, and a horizontal pipe that extends forward from the back side R part. The back side R part and the horizontal pipe include a water storage part that stores a part of washing water. The water storage part is arranged on a lower side of a back side lower end part of the drainage water trap part.

4 Claims, 4 Drawing Sheets

FLUSH TOILET

CROSS-REFERENCE TO RELATED APPLICATION(S)

The present application is based upon and claims the benefit of priority to Japanese Patent Application No. 2021-178357, filed on Oct. 29, 2021, the entire contents of which are herein incorporated by reference.

FIELD

A disclosed embodiment(s) relate(s) to a flush toilet.

BACKGROUND

A flush toilet conventionally includes a water drainage socket that connects a drainage water trap part that discharges a waste in a bowl part and a water drainage port of a floor surface. Furthermore, a plurality of kinds of water drainage sockets that are dependent on a shape of a piping are provided where, for example, a so-called backward-curved water drainage socket that is provided with an upstream side that is connected to a drainage water trap part and a downstream side that is once curved (extends) toward a back side of a toilet and subsequently extends toward a front side of such a toilet so as to be connected to a water drainage port and/or the like has/have been known (see, for example, U.S. Pat. No. 8,011,029).

Herein, a backward-curved water drainage socket has an advantage that a siphon action is readily caused, because a curved part of a flow channel is filled with a washing water in such a manner that a washing water that flows from an upper side is directed to a front side. On the other hand, in a backward-curved water drainage socket, a washing water that is discharged from a vicinity of a back side lower end part of a discharge port of a drainage water trap part that is connected to an upstream side thereof quickly flows toward a downstream side thereof, so that less contribution to activation of a siphon action is provided where no siphon action may be caused and a timing of activation of such a siphon action may be delayed. Thus, a conventional technique has room for improvement in that a siphon action is caused reliably and promptly.

SUMMARY

A flush toilet according to an aspect of an embodiment includes a bowl part that includes a waste-receiving surface with a bowl shape and a rim part that is formed on an upper side of the waste-receiving surface, a water spout part that is provided on the rim part and spouts a washing water toward an inside of the bowl part, a drainage water trap part that is connected to a bottom part of the bowl part and discharges a waste in the bowl part, and a water drainage socket that is provided with an upstream side that is connected to the drainage water trap part and a downstream side that is connected to a water drainage port of a floor surface, provides a flow channel for a washing water that is discharged from the drainage water trap part, and includes an upper side water drainage socket that extends downward from the drainage water trap part, a back side R part that is connected to the upper side water drainage socket and changes a flow channel in such a manner that a washing water that flows from an upper side is directed to a front side, and a horizontal pipe that extends forward from the back side R par, wherein the back side R part and the horizontal pipe include a water storage part that stores a part of a washing water, and the water storage part is arranged on a lower side of a back side lower end part of the drainage water trap part.

BRIEF DESCRIPTION OF DRAWING(S)

DESCRIPTION OF EMBODIMENT(S)

Hereinafter, an embodiment(s) of a flush toilet as disclosed in the present application will be explained in detail, with reference to the accompanying drawing(s). Additionally, this invention is not limited by an embodiment(s) as illustrated below.

Embodiment

Overall Configuration of Flush Toilet

Figure 1:
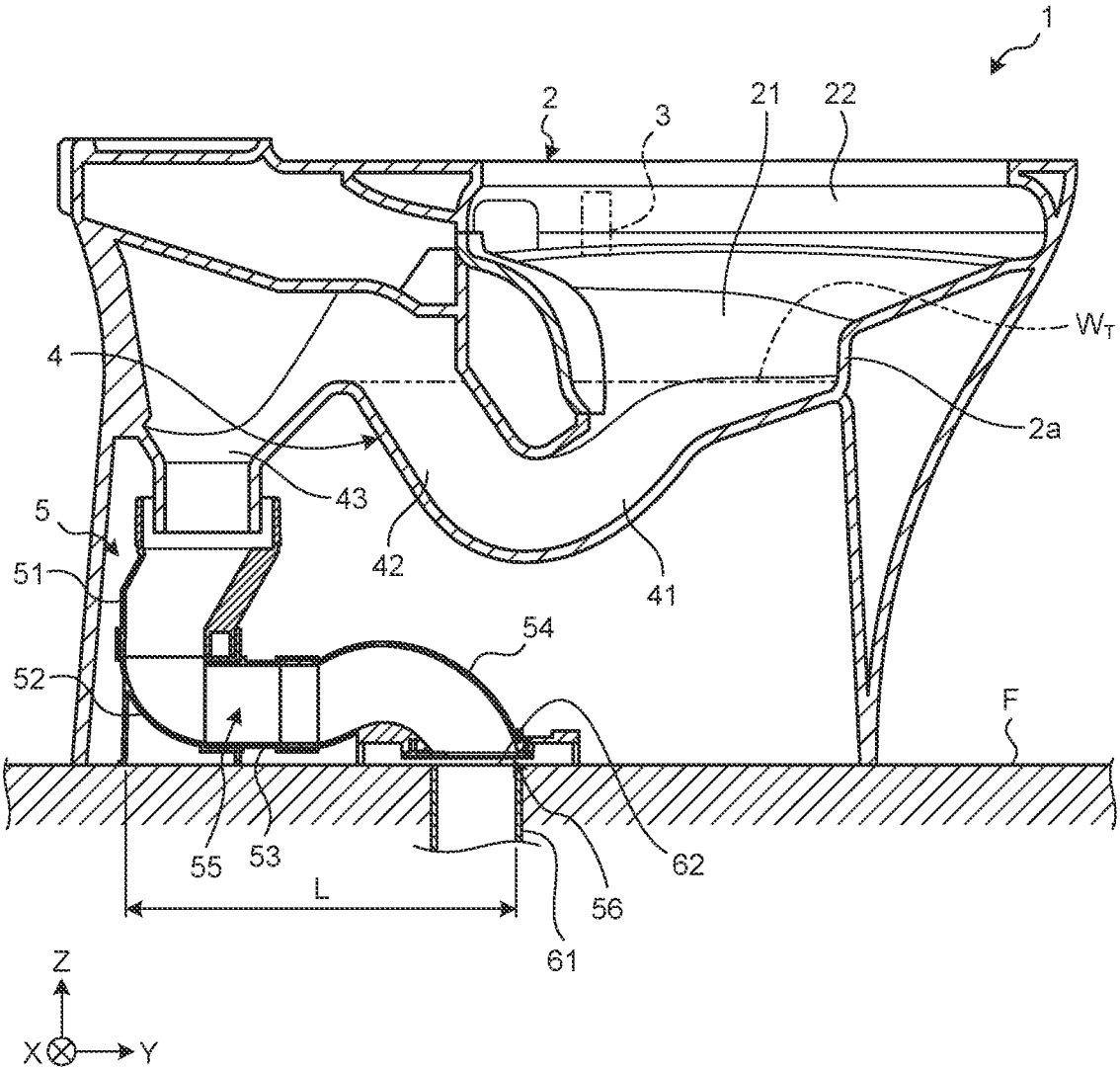
FIG. 1 is a side cross-sectional view that illustrates a flush toilet according to an embodiment.

First, an overall configuration of a flush toilet 1 according to an embodiment will be explained with reference to FIG. 1. FIG. 1 is a side cross-sectional view that illustrates a flush toilet 1 according to an embodiment. Additionally, FIG. 1 illustrates a three-dimensional orthogonal coordinate system that includes a Z-axis where a vertically upward direction is provided as a positive direction thereof, for providing a clear explanation. Such an orthogonal coordinate system may also be illustrated in another/other figure(s).

Furthermore, in a following explanation, a positive direction of an X-axis, a negative direction of such an X-axis, a positive direction of a Y-axis, a negative direction of such a Y-axis, a positive direction of a Z-axis, and a negative direction of such a Z-axis in an orthogonal coordinate system may be described as a "right side", a "left side", a "front side", a "back side", a "upper side", and a "lower side", respectively. Additionally, any of FIG. 1, FIG. 2, and a subsequently illustrated figure(s) is a schematic diagram.

As illustrated in FIG. 1, the flush toilet 1 includes a bowl part 2, a water spout part 3, a drainage water trap part 4, and a water drainage socket 5. Furthermore, the flush toilet 1 is a floor-mounted flush toilet. Additionally, although a toilet body that includes the bowl part 2 and/or the like is made of, for example, a ceramic, this is not limiting and it may be made of, for example, a resin or may be manufactured by combing a ceramic and a resin.

The bowl part 2 includes a waste-receiving surface 21 and a rim part 22. The waste-receiving surface 21 is formed into a bowl shape that is capable of receiving a waste. The rim part 22 is formed on an upper side of the waste-receiving surface 21 and is formed so as to compose an upper edge of the bowl part 2. Additionally, FIG. 1 omits illustration of some members such as a toilet seat that is provided on an upper part of the bowl part 2 and/or a cover that covers such a toilet seat, for simplification of illustration.

The water spout part 3 spouts a washing water toward an inside of the bowl part 2. For example, the water spout part 3 is provided on the rim part 22 and spouts a washing water that is supplied from a non-illustrated water storage tank into the bowl part 2 through a water spout port. Additionally, FIG. 1 schematically illustrates the water spout part 3 (a water spout port) by a long dashed double-dotted line, for simplification of illustration.

A washing water that is spouted from the water spout part 3 generates a swirling flow on, for example, the waste-receiving surface 21 of the bowl part 2 so as to execute washing of the bowl part 2. Furthermore, a washing water that is supplied to the bowl part 2 is stored in the bowl part 2 and the drainage water trap part 4 after toilet washing. Additionally, FIG. 1 illustrates a washing water that is stored in the bowl part 2 and the drainage water trap part 4 by a long dashed double-dotted line where such a washing water may be described as a storage water $W_T$ below. Thus, the drainage water trap part 4 and/or the like is/are filled with a storage water $W_T$, so that such a storage water $W_T$ functions as a seal water so as to prevent an odor and/or the like from a water drainage piping 61 as described later from flowing backward to a side of the bowl part 2.

As a configuration of the drainage water trap part 4 is explained, the drainage water trap part 4 is connected to a bottom part 2*a* of the bowl part 2 and discharges a waste in the bowl part 2 together with a washing water. In detail, the drainage water trap part 4 includes an inlet part 41, an ascending pipeline 42, and a descending pipeline 43.

The inlet part 41 is connected to a lower side of the waste-receiving surface 21 of the bowl part 2 so as to be continuous therewith and causes a washing water and/or a waste from the bowl part 2 to flow into the drainage water trap part 4. The ascending pipeline 42 is connected to the inlet part 41 and is formed so as to extend obliquely backward and upward from a downstream end part of the inlet part 41. The descending pipeline 43 is connected to the ascending pipeline 42 and is formed so as to extend downward from a downstream end part of the ascending pipeline 42. Furthermore, a downstream end part of the descending pipeline 43 is connected to the water drainage socket 5.

Therefore, in a case where toilet washing is executed, in the drainage water trap part 4, a washing water and/or a waste in the bowl part 2 is/are discharged to the water drainage socket 5, through the inlet part 41, the ascending pipeline 42, and the descending pipeline 43.

<Configuration of Water Drainage Socket (Part 1)>

Next, the water drainage socket 5 will be explained. The water drainage socket 5 discharges a washing water and/or a waste from the drainage water trap part 4 to the water drainage piping 61. For example, the water drainage socket 5 is provided with an upstream side that is connected to the drainage water trap part 4 (accurately, the descending pipeline 43 of the drainage water trap part 4) and a downstream side that is connected to a water drainage port 62 of a floor surface F, and hence, provides a flow channel that discharges a washing water and/or the like from the drainage water trap part 4 to the water drainage piping 61.

Furthermore, the water drainage socket 5 is a so-called backward-curved water drainage socket that is provided with an upstream side that is connected to the drainage water trap part 4 and a downstream side that is once curved to a back side of a toilet (a negative direction of a Y-axis) and subsequently extends toward a front side of such a toilet (a positive direction of a Y-axis) so as to be connected to the water drainage port 62, as described above.

Meanwhile, in the flush toilet 1 as described above, at a time of toilet washing, for example, the water drainage socket 5 is filled with a washing water so as to cause a siphon action and thereby discharge a waste. However, in a case where the water drainage socket 5 is, for example, a backward-curved water drainage socket, a length of a water drainage flow channel of the water drainage socket 5 (for example, a length L of a water drainage flow channel as illustrated in FIG. 1 in frontward and backward directions (directions of a Y-axis) and/or the like) is comparatively readily increased. Hence, in the flush toilet 1, a siphon action is not readily sustained to a downstream side of the water drainage socket 5, and as a result, a discharge performance thereof may be degraded. Additionally, an event where a siphon action is not readily sustained to a downstream side of the water drainage socket 5 as described above could occur in not only a backward-curved water drainage socket.

Figure 2:
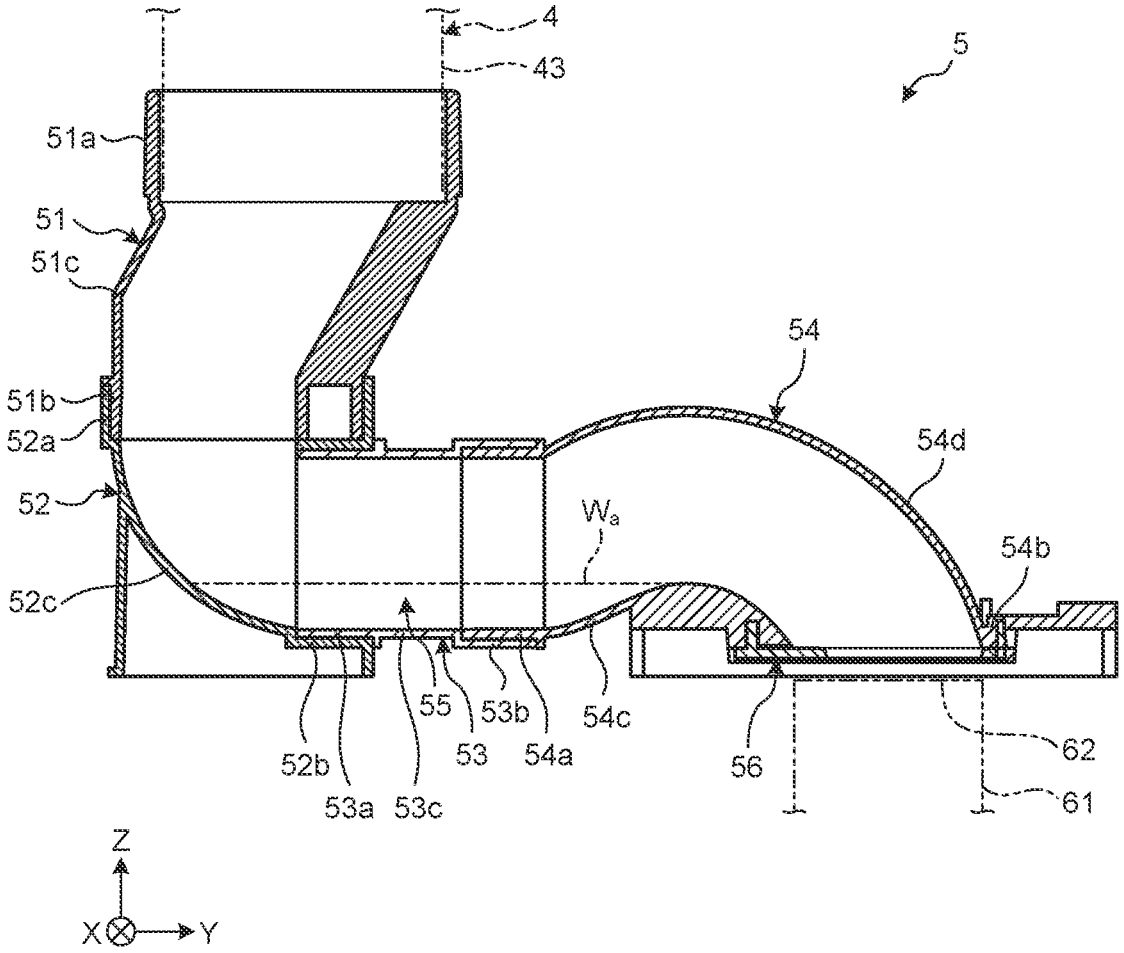
FIG. 2 is an enlarged cross-sectional view (part 1) of a water drainage socket.

Hence, the present embodiment is configured in such a manner that it is possible to improve a discharge performance for a waste. Hereinafter, such a configuration will specifically be explained with further reference to FIG. 2. FIG. 2 is an enlarged cross-sectional view of a water drainage socket 5.

As illustrated in FIG. 1 and FIG. 2, the water drainage socket 5 includes an upper side water drainage socket (a longitudinal pipe) 51, a back side R part 52, a front side water drainage socket (a horizontal pipe) 53, a front side R part 54, a water storage part 55, and a throttle part 56. Additionally, although the water drainage socket 5 is made of a resin, this is not limiting.

The longitudinal pipe 51 is a piping that extends in a vertical direction (a direction of a Z-axis) and causes a washing water that flows from an upper side to flow downward. For example, the longitudinal pipe 51 is provided with an upstream side end part 51*a* that is connected to the drainage water trap part 4 (accurately, the descending pipeline 43 of the drainage water trap part 4) and a downstream side end part 51*b* that is connected to the back side R part 52, as illustrated in FIG. 2.

An intermediate part 51*c* is formed between the upstream side end part 51*a* and the downstream side end part 51*b*. Such an intermediate part 51*c* is formed so as to be curved to a back side (a negative direction of a Y-axis), and thereby, a flow channel for the longitudinal pipe 51 is curved backward. Thereby, in the water drainage socket 5, a washing water readily fills a vicinity of a curved part of the longitudinal pipe 51, and hence, it is possible to readily cause a siphon action.

The back side R part 52 is a piping that is arranged on a back side of the flush toilet 1 and changes a flow channel in such a manner that a washing water that flows from an upper side is directed to a front side. For example, the back side R part 52 is provided with an upstream side end part 52*a* that is connected to the longitudinal pipe 51 (accurately, the downstream side end part 51*b* of the longitudinal pipe 51) and a downstream side end part 52*b* that is connected to the horizontal pipe 53.

A curved part 52*c* is formed between the upstream side end part 52*a* and the downstream side end part 52*b*. Such a curved part 52*c* is formed so as to be curved frontward and thereby change a flow channel for washing water that flows from an upper side to a flow channel that is directed to a front side.

The horizontal pipe 53 is a piping that extends in frontward and backward directions (directions of a Y-axis) and causes a washing water that flows from a back side to flow forward. For example, the horizontal pipe 53 is provided with an upstream side end part 53*a* that is connected to the back side R part 52 (accurately, the downstream side end part 52*b* of the back side R part 52) and a downstream side end part 53*b* that is connected to the front side R part 54.

An intermediate part 53*c* is formed between the upstream side end part 53*a* and the downstream side end part 53*b*.

Such an intermediate part 53*c* is formed so as to extend in frontward and backward directions, and hence, causes a washing water that flows from a back side to flow forward.

The front side R part 54 is a piping that is provided on a downstream side of the back side R part 52 and changes a flow channel in such a manner that a washing water that flows from a back side is directed to a lower side. For example, the front side R part 54 is provided with an upstream side end part 54*a* that is connected to the horizontal pipe 53 (accurately, the downstream side end part 53*b* of the horizontal pipe 53) and a downstream side end part 54*b* that is connected to the water drainage port 62 of the water drainage piping 61 through the throttle part 56.

An ascending part 54*c* and a descending part 54*d* are formed between the upstream side end part 54*a* and the downstream side end part 54*b*. The ascending part 54*c* is connected to the upstream side end part 54*a* and is formed so as to extend obliquely forward and upward from the upstream side end part 54*a*. The descending part 54*d* is connected to the ascending part 54*c* and is formed so as to extend downward from a downstream side of the ascending part 54*c*. Thus, the front side R part 54 is formed in such a manner that the ascending part 54*c* and the descending part 54*d* are curved, and thereby, changes a flow channel for a washing water that flows from a back side to a flow channel that is directed to a lower side.

Furthermore, the water drainage socket 5 includes the ascending part 54*c* that is formed in such a manner that the front side R part 54 extends obliquely frontward and upward, so that the water storage part 55 that stores a part of a washing water is formed on a flow channel from the back side R part 52 to the front side R part 54. Additionally, FIG. 2 illustrates a washing water that is stored in the water storage part 55 by a long dashed double-dotted line where such a washing water may be described as a storage water $W_a$ below.

Thus, the water drainage socket 5 includes the water storage part 55 where a storage water $W_a$ is stored constantly, so that, for example, at a time of toilet washing, such a storage water $W_a$ is utilized so as to fill an inside of a piping with a comparatively low amount of a washing water, and hence, it is possible to cause a siphon action promptly.

Configuration of Water Drainage Socket (Part 2)

Figure 3:
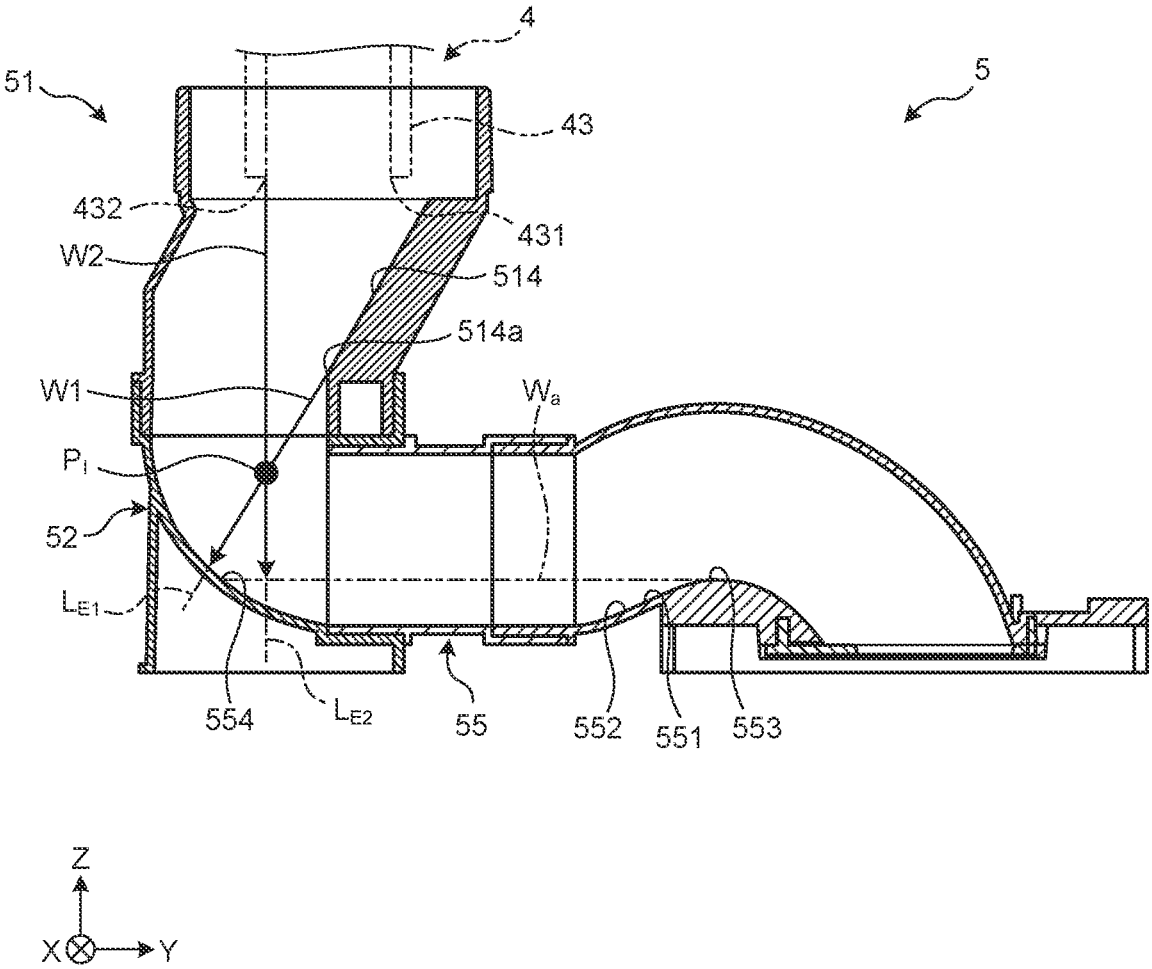
FIG. 3 is an enlarged cross-sectional view (part 2) of a water drainage socket.
Figure 4:
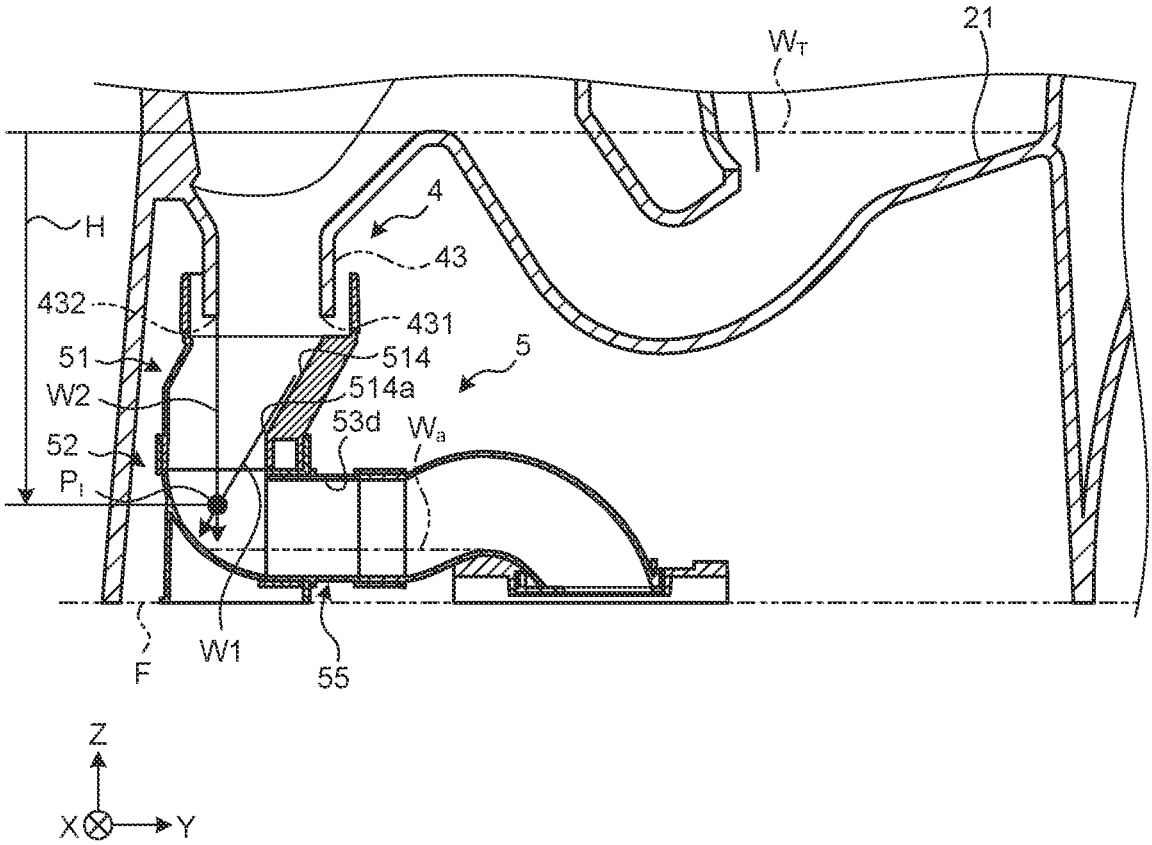
FIG. 4 is an explanatory diagram of a position of activation of a siphon.

Next, the water drainage socket 5 will be explained in more detail with reference to FIG. 3 and FIG. 4. FIG. 3 is an enlarged cross-sectional view of a water drainage socket 5. As illustrated in FIG. 3, the water drainage socket 5 includes an upper side water drainage socket (a longitudinal pipe) 51 where a washing water that is discharged from a descending pipeline 43 of a drainage water trap part 4 flows downward and a back side R part 52 that is connected to such a longitudinal pipe 51 in such a manner that a washing water that flows from an upper side changes a direction thereof to a front side and flows therethrough.

As illustrated in FIG. 3, the longitudinal pipe 51 forms a flow channel where a washing water flows downward. The back side R part 52 forms a flow channel where a washing water flows from a back side to a front side. A horizontal pipe 53 forms a flow channel where a washing water flows from a back side to a front side.

A water storage part 55 has a sloping surface 551 that slopes upward toward a side of a front end part 553 thereof, on a bottom surface on a downstream side. The sloping surface 551 forms a recessed part 552 that is provided in a state where a bottom surface is recessed toward a lower side. A slope angle of the water storage part 55 toward a side of the front end part 553 is gradually increased by the sloping surface 551.

Thus, a slope angle of the water storage part 55 toward a side of the front end part 553 is gradually increased, so that retention of a waste that is caused by a sharp change of a slope angle is prevented or reduced, for example, even in a case where a high volume of a waste flows from the water storage part 55 to a downstream side.

Additionally, the front end part 553 and a back end part 554 of the water storage part 55 are also parts that are defined by front and back ends of a storage water $W_a$ and are capable of being changed depending on an amount of such a storage water $W_a$.

Furthermore, the water storage part 55 is arranged on a lower side of a back side lower end part 432 of the drainage water trap part 4 (the descending pipeline 43) on an upstream side. Thus, the water storage part 55 is arranged on a lower side of the back side lower end part 432 of the drainage water trap part 4 (the descending pipeline 43), so that a part of a washing water that is discharged from the drainage water trap part 4 directly flows into the water storage part 55 without striking an inner wall of the water drainage socket 5 (specifically, an inner wall(s) of the longitudinal pipe 51 and/or the back side R part 52) and hence it is possible to utilize a washing water (a storage water $W_a$) that is stored in the water storage part 55 promptly. Thus, a full water state of a flow channel is created in a vicinity of the back end part 554 of the water storage part 55 in the water drainage socket 5 by utilizing a washing water without a loss thereof, so that a timing of activation of a siphon action is accelerated.

The longitudinal pipe 51 has a sloping part 514 that slopes downward and backward from an upstream side to a downstream side. The water storage part 55 is arranged on an extended line $L_{E1}$ from a lower end part 514*a* of the sloping part 514. Thus, the water storage part 55 is arranged on an extended line $L_{E1}$ from the lower end part 514*a* of the sloping part 514, so that a washing water W2 that is discharged from a vicinity of the back side lower end part 432 of the drainage water trap part 4 (the descending pipeline 43) and also a washing water W1 that is discharged from a vicinity of a front side lower end part 431 of the drainage water trap part 4 (the descending pipeline 43), strikes the sloping part 514, flows along a front side surface (a sloping surface) of the sloping part 514, and subsequently flows downward flow into the water storage part 55 promptly. Hence, it is possible to create a full water state of a flow channel in a vicinity of the back end part 554 of the water storage part 55 in the water drainage socket 5 by utilizing a washing water (a storage water $W_a$) that is stored in the water storage part 55 promptly, so that a timing of activation of a siphon action is accelerated.

Furthermore, in a side view, a point of intersection $P_I$ where an extended line $L_{E2}$ that extends downward from the back side lower end part 432 of the drainage water trap part 4 (the descending pipeline 43) and an extended line $L_{E1}$ that extends downward from the lower end part 514*a* of the sloping part 514 along a slope of a front side surface (a sloping surface) of the sloping part 514 intersect is arranged above the water storage part 55.

Thus, a point of intersection $P_T$ between two extended lines $L_{E1}$, $L_{E2}$ is arranged above the water storage part 55, so that a washing water W2 that is discharged from a vicinity of the back side lower end part 432 of the drainage water trap part 4 (the descending pipeline 43) and a washing water W1 that is discharged from a vicinity of the front side lower end part 431 of the drainage water trap part 4 (the descending pipeline 43), strikes the sloping part 514, flows along a front side surface (a sloping surface), and runs obliquely backward in a state where a water strength is maintained from the lower end part 514*a* of the sloping part 514 intersect above the water storage part 55. Hence, it is possible to utilize a washing water (a storage water $W_a$) that is stored in the water storage part 55 promptly and create retention of a washing water(s) W1, W2 in a vicinity of the back end part 554 of the water storage part 55, so that it is possible to create a full water state of a flow channel in the water drainage socket 5 quickly.

Herein, a position of activation of a siphon will be explained with reference to FIG. 4. FIG. 4 is an explanatory diagram of a position of activation of a siphon. Additionally, FIG. 4 illustrates a side cross section of a part of a flush toilet 1 (see FIG. 1) that includes a water drainage socket 5. As illustrated in FIG. 4, in a side view, a point of intersection $P_T$ between two extended lines $L_{E1}$, $L_{E2}$ is arranged below an upper end part 53*d* of a horizontal pipe 53.

Thus, a point of intersection $P_T$ between two extended lines $L_{E1}$, $L_{E2}$ is arranged below the upper end part 53*d* of the horizontal pipe 53, so that it is possible to create retention of a washing water(s) W1, W2 at such a point of intersection $P_T$. That is, an amount of a water is increased at a point of intersection $P_T$, so that it is possible to create a full water state of a flow channel in the water drainage socket 5 quickly.

Furthermore, one part of a flow channel of the water drainage socket 5 is filled with a washing water so as to activate a siphon action and a point of intersection $P_I$ between two extended lines $L_{E1}$, $L_{E2}$ is arranged below the upper end part 53*d* of the horizontal pipe 53, so that it is possible to set a position of activation of a siphon (a position where a pipe filling state is first attained, on a flow channel of the water drainage socket 5) at a positon that is close to a floor surface F. Hence, a drop H from an upper surface (a storage water surface) of a storage water $W_T$ is increased, so that it is possible to generate a high amount of a potential energy in a case where a siphon action is caused. Thus, as a potential energy is increased, a drawing power that is provided by a siphon action is enhanced.

Furthermore, as a drop H of a waste-receiving surface 21 from an upper surface (a storage water surface) of a storage water $W_T$ is increased, it is possible to ensure such a drop H sufficiently, for example, even if a height of an upper surface (a storage water surface) of such a storage water $W_T$ is decreased in a case where a range of such a storage water $W_T$ is extended in order to prevent or reduce attachment of a waste to the waste-receiving surface 21, and a potential energy is also not decreased, so that a drawing power that is provided by a siphon action is maintained.

As explained above, according to an embodiment as described above, a part of a washing water that is discharged from a drainage water trap part 4 (a descending pipeline 43) directly flows into a water storage part 55 without striking an inner wall of a water drainage socket 5, so that it is possible to create a full water state of a flow channel in a vicinity of a back end part 554 of a water storage part 55 in the water drainage socket 5 by utilizing a washing water that is stored in the water storage part 55 promptly. Thereby, it is possible to cause a siphon action reliably and promptly, and further, for example, even in a situation(s) of washing with a low amount thereof in recent water saving and/or tornado washing that is caused by a rim water spout, it is possible to cause such a siphon action reliably and promptly.

Furthermore, a washing water W2 that is discharged from a vicinity of a back side lower end part 432 of the drainage water trap part 4 (the descending pipeline 43) and directly flows into the water storage part 55 and also a washing water W1 that is discharged from a vicinity of a front side lower end part 431 of the drainage water trap part 4 (the descending pipeline 43), strikes a sloping part 514, flows along a front side surface (a sloping surface) of the sloping part 514, and subsequently flows downward flow into the water storage part 55 promptly. Thereby, it is possible to create a full water state of a flow channel in a vicinity of the back end part 554 of the water storage part 55 in the water drainage socket 5 by utilizing a washing water (a storage water $W_a$) that is stored in the water storage part 55.

Furthermore, a washing water W2 that is discharged from a vicinity of the back side lower end part 432 of the drainage water trap part 4 (the descending pipeline 43) and a washing water W1 that is discharged from a vicinity of the front side lower end part 431 of the drainage water trap part 4 (the descending pipeline 43), strikes the sloping part 514, flows along a front side surface (a sloping surface) of the sloping part 514, and runs obliquely backward in a state where a water strength is maintained from a lower end part 514*a* of the sloping part 514 intersect above the water storage part 55. Hence, it is possible to utilize a washing water (a storage water $W_a$) that is stored in the water storage part 55 promptly and create retention of a washing water(s) W1, W2 in a vicinity of the back end part 554 of the water storage part 55, so that it is possible to create a full water state of a flow channel in the water drainage socket 5 quickly. Thereby, for example, even in a situation(s) of washing with a low amount thereof in recent water saving and/or tornado washing that is caused by a rim water spout, it is possible to cause a siphon action reliably and promptly.

Furthermore, in order to create a full water state of a flow channel in the water drainage socket 5 quickly by utilizing a washing water (a storage water $W_a$) that is stored in the water storage part 55, it is possible to set a position of activation of a siphon at a low position. Hence, a drop H from an upper surface (a storage water surface) of a storage water $W_T$ is increased, so that it is possible to generate a high amount of a potential energy in a case where a siphon action is caused. Thereby, for example, even if a height of an upper surface (a storage water surface) of a storage water $W_T$ is decreased in a case where a range of such a storage water $W_T$ is extended in order to prevent or reduce attachment of a waste to a waste-receiving surface 21, it is possible to cause a siphon action reliably.

Additionally, although, in an embodiment as described above, the back end part 554 of the water storage part 55 is arranged in a vicinity (a slightly front side) of an extended line $L_{E1}$ from the lower end part 514*a* of the sloping part 514 so that a washing water W1 that is discharged from a vicinity of the front side lower end part 431 of the drainage water trap part 4 (the descending pipeline 43) is utilized for prompt activation of a siphon action, for example, the back end part 554 of the water storage part 55 may be arranged on an extended line $L_{E1}$ from the lower end part 514*a* of the sloping part 514. Thereby, it is possible to utilize a washing water W1 more efficiently for prompt activation of a siphon action.

An aspect of an embodiment aims to provide a flush toilet that is capable of causing a siphon action reliably and promptly.

A flush toilet according to an aspect of an embodiment includes a bowl part that has a waste-receiving surface with a bowl shape and a rim part that is formed on an upper side of the waste-receiving surface, a water spout part that is provided on the rim part and spouts a washing water toward an inside of the bowl part, a drainage water trap part that is connected to a bottom part of the bowl part and discharges a waste in the bowl part, and a water drainage socket that is provided with an upstream side that is connected to the drainage water trap part and a downstream side that is connected to a water drainage port of a floor surface, and provides a flow channel for a washing water that is discharged from the drainage water trap part where the water drainage socket has an upper side water drainage socket that extends downward from the drainage water trap part, a back side R part that is connected to the upper side water drainage socket and changes a flow channel in such a manner that a washing water that flows from an upper side is directed to a front side, and a horizontal pipe that extends forward from the back side R par, wherein the back side R part and the horizontal pipe have a water storage part that stores a part of a washing water, and the water storage part is arranged on a lower side of a back side lower end part of the drainage water trap part.

In such a configuration, a part of a washing water that is discharged from a drainage water trap part directly flows into a water storage part without striking an inner wall of a water drainage socket, so that it is possible to create a full water state of a flow channel in a vicinity of a back end part of such a water storage part in such a water drainage socket by promptly utilizing a washing water that is stored in such a water storage part. Thereby, it is possible to cause a siphon action reliably and promptly, and further, for example, even in a situation(s) of washing with a low amount thereof in recent water saving and/or tornado washing that is caused by a rim water spout, it is possible to cause such a siphon action reliably and promptly.

Furthermore, in the flush toilet as described above, the upper side water drainage socket has a sloping part that slopes downward and backward from an upstream side to a downstream side, and a back end part of the water storage part is arranged in a vicinity on an extended line from a lower end part of the sloping part.

In such a configuration, a washing water that is discharged from a vicinity of a back side lower end part of a drainage water trap part and directly flows into a water storage part and also a washing water that is discharged from a vicinity of a front side lower end part of such a drainage water trap part, strikes a sloping part, flows along a front side surface (a sloping surface) of such a sloping part, and subsequently flows downward flow into such a water storage part promptly. Thereby, it is possible to create a full water state of a flow channel in a vicinity of a back end part of a water storage part in a water drainage socket by utilizing a washing water that is stored in such a water storage part, so that it is possible to cause a siphon action more promptly.

Furthermore, in the flush toilet as described above, the upper side water drainage socket has a sloping part that slopes downward and backward from an upstream side to a downstream side, and in a side view, an extended line that extends downward from a back side lower end part of the drainage water trap part and an extended line that extends downward from a lower end part of the sloping part along a slope of the sloping part intersect above the water storage part.

In such a configuration, a washing water that is discharged from a vicinity of a back side lower end part of a drainage water trap part and a washing water that is discharged from a vicinity of a front side lower end part of such a drainage water trap part, strikes a sloping part, flows along a front side surface (a sloping surface) of such a sloping part, and runs obliquely backward in a state where a water strength is maintained from a lower end part of such a sloping part intersect above a water storage part. Hence, it is possible to utilize a washing water (a storage water) that is stored in a water storage part promptly and create retention of a washing water in a vicinity of a back end part of such a water storage part, so that it is possible to create a full water state of a flow channel in a water drainage socket quickly. Thereby, it is possible to cause a siphon action reliably and promptly, for example, even in a situation(s) of washing with a low amount thereof in recent water saving and/or tornado washing that is caused by a rim water spout.

Furthermore, in the flush toilet as described above, the upper side water drainage socket has a sloping part that slopes downward and backward from an upstream side to a downstream side, and in a side view, a point of intersection between an extended line that extends downward from a back side lower end part of the drainage water trap part and an extended line that extends downward from a lower end part of the sloping part along a slope of the sloping part is arranged below an upper end part of the horizontal pipe.

In such a configuration, in order to create a full water state of a flow channel in a water drainage socket quickly by utilizing a washing water (a storage water) that is stored in a water storage part, it is possible to set a position of activation of a siphon for causing a siphon action (for example, a part that is narrow so as to cause a resistance in a flow channel for a washing water) at a low position. Hence, a drop from a storage water surface of a bowl part is increased, so that it is possible to generate a high amount of a potential energy in a case where a siphon action is caused.

According to an aspect of an embodiment, it is possible to cause a siphon action reliably and promptly.

It is possible for a person(s) skilled in the art to readily derive an additional effect(s) and/or variation(s). Hence, a broader aspect(s) of the present invention is/are not limited to a specific detail(s) and a representative embodiment(s) as illustrated and described above. Therefore, various modifications are possible without departing from the spirit or scope of a general inventive concept that is defined by the appended claim(s) and an equivalent(s) thereof.

What is claimed is:

1. A flush toilet, comprising:

a bowl part that includes a waste-receiving surface with a bowl shape and a rim part that is formed on an upper side of the waste-receiving surface;

a water spout part that is provided on the rim part and spouts a washing water toward an inside of the bowl part;

a drainage water trap part that is connected to a bottom part of the bowl part and discharges a waste in the bowl part; and a water drainage socket that is provided with an upstream side that is connected to the drainage water trap part and a downstream side that is connected to a water drainage port of a floor surface, provides a flow channel for a washing water that is discharged from the drainage water trap part, and includes an upper side water drainage socket that extends downward from the drainage water trap part, a back side R part that is connected to the upper side water drainage socket and changes a flow channel in such a manner that a washing water that flows from an upper side is directed to a front side, and a horizontal pipe that extends forward from the back side R part, wherein the back side R part and the horizontal pipe include a water storage part that stores a part of a washing water, and the water storage part is arranged on a lower side of a back side lower end part of the drainage water trap part in such a manner that a back end part of the water storage part is arranged at a back side of an extended line that extends downward from the back side lower end part of the drainage water trap part.

2. The flush toilet according to claim 1, wherein:

the upper side water drainage socket includes a sloping part that slopes downward and backward from an upstream side to a downstream side; and the back end part of the water storage part is arranged in a vicinity on an extended line from a lower end part of the sloping part.

3. A flush toilet, comprising:

a bowl part that includes a waste-receiving surface with a bowl shape and a rim part that is formed on an upper side of the waste-receiving surface;

a water spout part that is provided on the rim part and spouts a washing water toward an inside of the bowl part;

a drainage water trap part that is connected to a bottom part of the bowl part and discharges a waste in the bowl part; and a water drainage socket that is provided with an upstream side that is connected to the drainage water trap part and a downstream side that is connected to a water drainage port of a floor surface, provides a flow channel for a washing water that is discharged from the drainage water trap part, and includes an upper side water drainage socket that extends downward from the drainage water trap part, a back side R part that is connected to the upper side water drainage socket and changes a flow channel in such a manner that a washing water that flows from an upper side is directed to a front side, and a horizontal pipe that extends forward from the back side R part, wherein the back side R part and the horizontal pipe include a water storage part that stores a part of a washing water, and the water storage part is arranged on a lower side of a back side lower end part of the drainage water trap part, wherein:

the upper side water drainage socket includes a sloping part that slopes downward and backward from an upstream side to a downstream side; and in a side view, an extended line that extends downward from a back side lower end part of the drainage water trap part and an extended line that extends downward from a lower end part of the sloping part along a slope of the sloping part intersect above the water storage part.

4. A flush toilet, comprising:

a bowl part that includes a waste-receiving surface with a bowl shape and a rim part that is formed on an upper side of the waste-receiving surface;

a water spout part that is provided on the rim part and spouts a washing water toward an inside of the bowl part;

a drainage water trap part that is connected to a bottom part of the bowl part and discharges a waste in the bowl part; and a water drainage socket that is provided with an upstream side that is connected to the drainage water trap part and a downstream side that is connected to a water drainage port of a floor surface, provides a flow channel for a washing water that is discharged from the drainage water trap part, and includes an upper side water drainage socket that extends downward from the drainage water trap part, a back side R part that is connected to the upper side water drainage socket and changes a flow channel in such a manner that a washing water that flows from an upper side is directed to a front side, and a horizontal pipe that extends forward from the back side R part, wherein the back side R part and the horizontal pipe include a water storage part that stores a part of a washing water, and the water storage part is arranged on a lower side of a back side lower end part of the drainage water trap part, wherein:

the upper side water drainage socket includes a sloping part that slopes downward and backward from an upstream side to a downstream side; and in a side view, a point of intersection between an extended line that extends downward from a back side lower end part of the drainage water trap part and an extended line that extends downward from a lower end part of the sloping part along a slope of the sloping part is arranged below an upper end part of the horizontal pipe.

* * * * *